US007759617B2

(12) United States Patent
Bowles et al.

(10) Patent No.: US 7,759,617 B2
(45) Date of Patent: Jul. 20, 2010

(54) GAS RANGE AND METHOD FOR USING THE SAME

(75) Inventors: Howard Richard Bowles, Louisville, KY (US); John Mark Smith, Louisville, KY (US); Timothy Scott Shaffer, La Grange, KY (US); David Joseph Najewicz, Prospect, KY (US)

(73) Assignee: General Electric Company, Schenectady, NY (US)

( * ) Notice: Subject to any disclaimer, the term of this patent is extended or adjusted under 35 U.S.C. 154(b) by 806 days.

(21) Appl. No.: 10/980,410

(22) Filed: Nov. 3, 2004

(65) Prior Publication Data

US 2006/0090741 A1 May 4, 2006

(51) Int. Cl.
*H05B 3/68* (2006.01)
*F27B 5/14* (2006.01)

(52) U.S. Cl. ..... 219/452.11; 219/390

(58) Field of Classification Search ..... 219/451.1, 219/452.11, 452.12, 452.13, 448.11, 448.12, 219/391, 406; 126/273 R, 39 R, 41 R, 39 BA, 126/19 R; 392/304–310
See application file for complete search history.

(56) References Cited

U.S. PATENT DOCUMENTS 2,463,712 A 3/1949 Newell
2,908,234 A 10/1959 Naylor
3,423,568 A 1/1969 Meckley, III et al.
4,629,865 A * 12/1986 Freedman et al. ..... 219/405
5,193,522 A 3/1993 Damsteegt et al.
5,275,147 A 1/1994 Aktinson, III
5,492,055 A 2/1996 Nevin et al.
5,791,890 A * 8/1998 Maughan ..... 431/6
5,909,533 A 6/1999 Kitabayashi et al.
6,216,683 B1 * 4/2001 Maughan ..... 126/19 R
6,222,163 B1 4/2001 Arntz et al.
6,417,493 B1 * 7/2002 Bales et al. ..... 219/400
6,734,403 B2 * 5/2004 Baker et al. ..... 219/486
6,943,324 B2 * 9/2005 Ahuja ..... 219/446.1

* cited by examiner

*Primary Examiner*—Sang Y Paik
(74) *Attorney, Agent, or Firm*—George L. Rideout, Esq.; Armstrong Teasdale LLP

(57) ABSTRACT

A gas range includes a gas cooktop including a plurality of gas cooktop burners, and an oven coupled to the gas cooktop. The oven includes an oven cavity comprising a top portion, a bottom portion, a rear portion coupled to the top and bottom portions, a first side portion, and a second side portion, the first and second side portions coupled to the top, bottom, and rear portions respectively, at least one gas oven burner positioned proximate to the bottom portion within the oven cavity; and a first electrical heating element positioned proximate the top portion within the oven cavity.

12 Claims, 6 Drawing Sheets

GAS RANGE AND METHOD FOR USING THE SAME

BACKGROUND OF THE INVENTION

This invention relates generally to a cooking appliance, and more particularly, to a gas cooking appliance.

At least some known gas fired stoves, ovens, and/or ranges include one or more gas heating elements that are coupled to a main gas line that is configured to supply gas to the heating elements, such as surface burners, broilers, and baking elements. Whereas, at least some known electric ranges include electric surface burners, electric broilers, and at least one electric baking element within the oven cavity.

At least some known consumers perceive electric ovens as having the best cooking performance. Specifically, at least some known consumers prefer an appliance that includes gas surface burners to perform food preparation on the surface of the appliance, whereas other known consumers prefer an electrical baking element that is positioned within the oven cavity to perform baking. Accordingly, consumers often select an appliance that includes only gas heating elements or an appliance that includes only electrical heating elements.

During installation, the serviceman or contractor wires the consumers home such that the necessary power is supplied to the appliance. For example, when a consumer selects a gas cooking appliance, the serviceman may install wiring, an electrical breaker, and an outlet to provide approximately 120 volts to the gas appliance. Alternatively, when a consumer selects an electric cooking appliance, the serviceman may install additional wiring, a higher amperage circuit breaker, and a different outlet such that approximately 240 volts is supplied to the electric burners, broiler, and baking element.

However, if a consumers currently has a gas cooking appliance installed, and desires to install an electric cooking appliance, the house must be rewired such that 240 volts is supplied to the electric cooking appliance. Accordingly, a serviceman may install a new circuit breaker, upgraded electrical wiring, and an outlet configured to deliver 240 volts to the electric appliance. Converting a household from a gas cooking appliance to an electric appliance increases the costs to the consumer, without providing the consumer with the optimal gas and electric cooking appliance desired by the consumer. Accordingly, some consumers may select an appliance that includes a gas cooking element rather than an electric baking element to facilitate reducing and/or eliminating installation costs.

BRIEF DESCRIPTION OF THE INVENTION

In one aspect, a gas range that includes a gas cooktop including a plurality of gas cooktop burners, and an oven coupled to the gas cooktop is provided. The oven includes an oven cavity comprising a top portion, a bottom portion, a rear portion coupled to the top and bottom portions, a first side portion, and a second side portion, the first and second side portions coupled to the top, bottom, and rear portions respectively, at least one gas oven burner positioned proximate to the bottom portion within the oven cavity; and a first electrical heating element positioned proximate the top portion within the oven cavity.

In another aspect, a method for operating a cooking appliance during the cooking process is provided. The cooking appliance includes an oven cavity, an electrical heating element, a gas burner, a first temperature sensor and a second temperature sensor positioned within the oven cavity. The method includes receiving a first temperature from the first temperature sensor, receiving a second temperature from the second temperature sensor, preheating the oven cavity by turning on the gas burner, and maintaining the temperature in the oven cavity using the first electrical heating element based on a signal received from the second temperature sensor.

In a further aspect, a convection fan for a gas cooking appliance is provided. The convection fan includes a convection fan impeller, a convection heating element circumscribing the convection fan impeller, and a convection fan cover circumscribing the convection heating element.

DETAILED DESCRIPTION OF THE INVENTION

Figure 1:
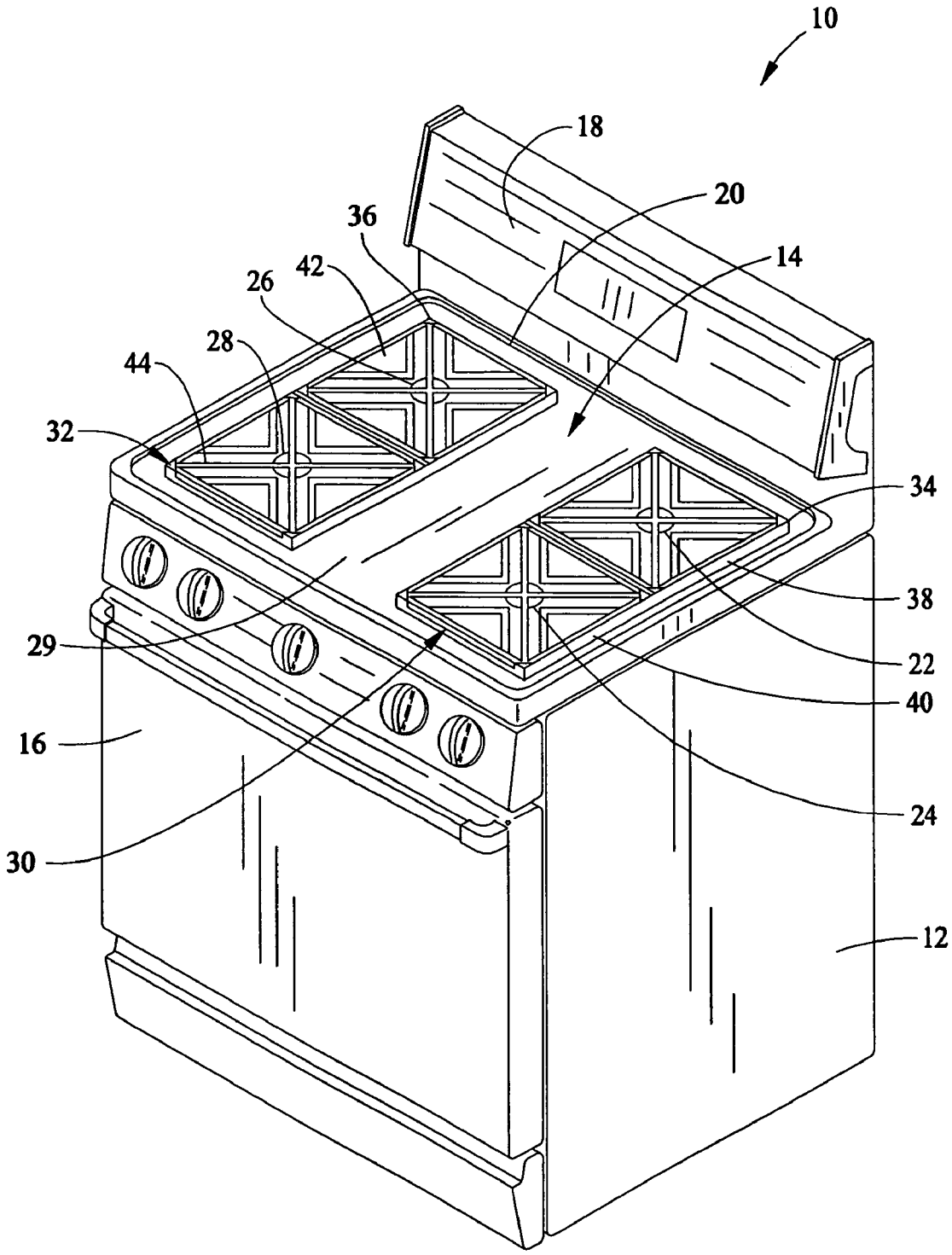
FIG. 1 is a perspective view of a dual fuel oven.

FIG. 1 illustrates a gas cooking appliance in the form of a free standing gas range 10 including an outer body or cabinet 12 that incorporates a generally rectangular cooktop 14. An oven, not shown, is positioned below cooktop 14 and has a front-opening access door 16. In one embodiment, a range backsplash 18 extends upward of a rear edge 20 of cooktop 14 and contains various control selectors (not shown) for selecting operative features of heating elements for cooktop 14 and the oven. In another embodiment, the various control selectors are integrated into a front portion of cooktop 14 as shown in FIG. 1. It is contemplated that the present invention is applicable, not only to cooktops which form the upper portion of a range, such as range 10, but to other forms of cooktops as well, such as, but not limited to, free standing cooktops that are mounted to kitchen counters. Therefore, gas range 10 is provided by way of illustration rather than limitation, and accordingly there is no intention to limit application of the present invention to any particular appliance or cooktop, such as range 10 or cooktop 14. In addition, it is contemplated that the present invention is applicable to dual fuel cooking appliances, e.g., a gas cooktop with an electric ovens Cooktop 14 includes four gas fueled burners 22, 24, 26, 28 which are positioned in spaced apart pairs 22, 24 and 26, 28 positioned adjacent each side of cooktop 14. Each pair of burners 22, 24 and 26, 28 is surrounded by a recessed area (not shown in FIG. 1) respectively, of cooktop 14. The recessed areas are positioned below the upper surface 29 of cooktop 14 and serve to catch any spills from cooking utensils being used with cooktop 14. Each burner 22, 24, 26, 28 extends upwardly through an opening in cooktop 14, and a grate assembly 30, 32 is positioned over each respective pair of burners, 22, 24 and 26, 28. Each grate assembly 30, 32 includes a respective frame 34, 36, and separate utensil supporting grates 38, 40, 42, 44 are positioned above the cooktop recessed areas and overlie respective burners 22, 24, 26, 28 respectively.

The construction and operation of the range heating elements, including cooktop gas burners 22, 24, 26, 28 are believed to be within the purview of those in the art without further discussion.

Figure 2:
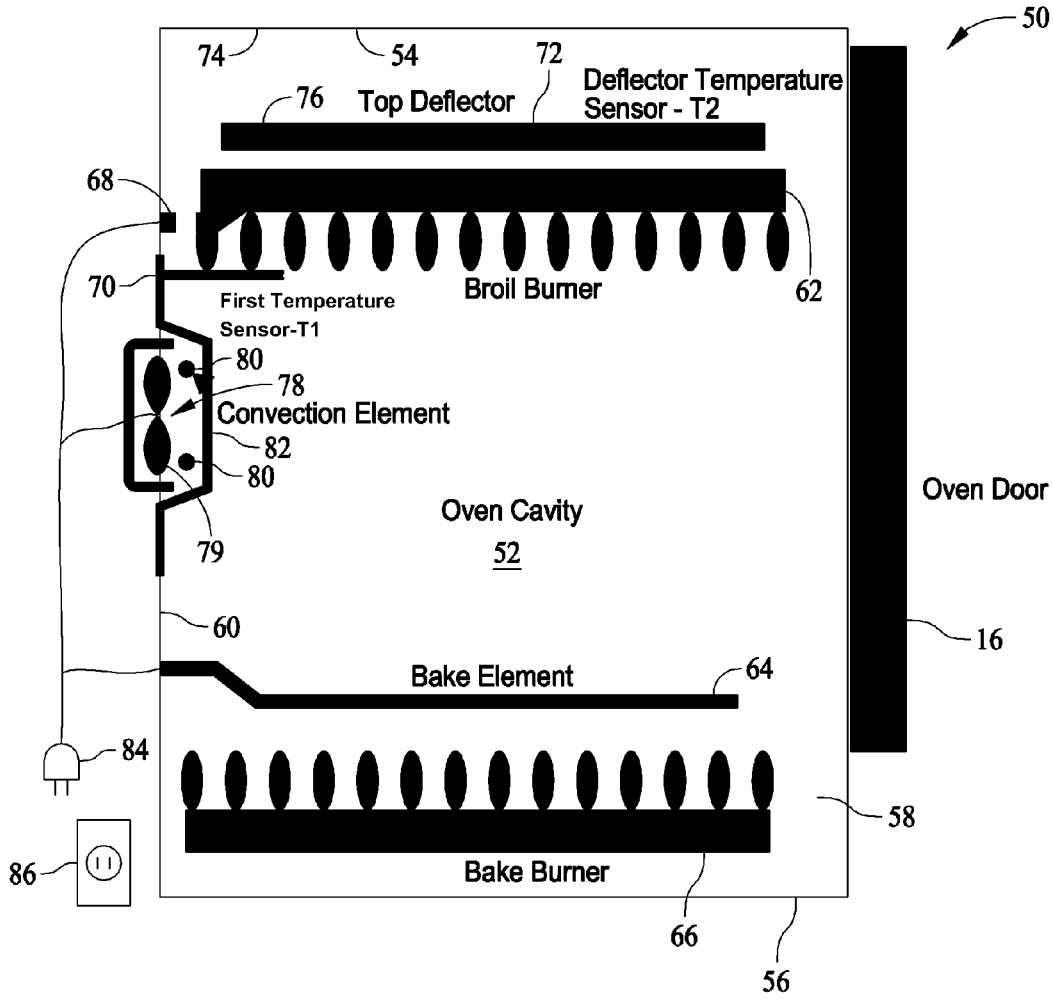
FIG. 2 is a schematic cross-sectional view of a dual fuel oven.

FIG. 2 is a schematic cross-sectional view of a portion of dual fuel oven 50 that can be used with gas range 10 (shown in FIG. 1). Oven 50 includes an oven cavity 52 formed by a top wall 54, a bottom wall 56, two side walls 58, and a back wall 60. Front-opening access door 16 is hinged on one of side walls 58 and covers oven cavity 52.

In an exemplary embodiment, oven 50 includes an upper gas burner 62, i.e. a broil burner, positioned at an upper portion of oven cavity 52, and a lower electrical heating element 64, i.e. a bake element, positioned at the lower portion of oven cavity 52. In another exemplary embodiment, oven 50 includes upper gas burner 62, lower electrical heating element 64, and a lower gas burner 66, i.e. a bake element. In another exemplary embodiment, oven 50 includes upper gas burner 62, lower electrical heating element 64, lower gas burner 66, and an upper electrical heating element 68. In yet another exemplary embodiment, oven 50 includes upper lower electrical heating element 64, lower gas burner 66, and an upper electrical heating element 68.

More specifically, lower gas burner 66 is mounted within bottom wall 56, lower electrical heating element 64 is positioned above lower gas burner 66, upper gas burner 62 is positioned at the upper portion of oven cavity 52, and upper electrical heating element 68 is positioned below gas burner 62, and is substantially parallel to top wall 54. In the exemplary embodiment, upper and lower electrical heating elements 64, 68 are positioned such that a flame from upper and lower gas burners 62, 66 will not impinge upon upper and lower electrical heating elements 64, 68 respectively.

Oven 50 also includes a first temperature sensor or probe 70 that extends at least partially into oven cavity 52. In the exemplary embodiment, first temperature sensor 70 is positioned below upper gas burner 62 and upper electrical heating element 68, and is positioned above lower gas burner 66 and lower electrical heating element 64. In the exemplary embodiment, oven 50 includes a second temperature sensor 72 that is coupled to an upper surface 74 of oven cavity 52. In alternative embodiment, oven 50 includes a top deflector 76 that is mounted on upper surface 74, and second temperature sensor 72 is coupled to top deflector 76, to facilitate monitoring a temperature of top deflector 76.

In the exemplary embodiment, first temperature sensor 70 is positioned between upper and lower gas burners 62 and 66, such that a signal received from first temperature sensor 70 represents an air temperature in oven cavity 52 approximately midway between upper and lower gas burners 62 and 66. In the exemplary embodiment, second temperature sensor 72 is coupled to upper surface 74 (shown in FIG. 2) of oven cavity 52 and transmits a signal that represents the upper surface temperature. In an alternative embodiment, oven 50 includes top deflector 76 (shown in FIG. 2), second temperature sensor 72 is coupled to top deflector 76, and transmits a signal that represents a surface temperature of top deflector 76.

In another exemplary embodiment, oven 50 also includes a convection fan 78, including an impeller 79, that is disposed on back wall 60 of oven cavity 52. Convection fan 78 is in air flow communication with oven cavity. During operation, convection fan 78 creates an air current through a convection heating element 80 and into oven cavity 52 to facilitate cooking food positioned within oven cavity 52. A fan cover 82 is disposed at least partially over convection heating element 80.

Oven 50 also includes a power interface 84 that is electrically coupled to a 120 volt power supply 86. Specifically, power supply 84 facilitates supplying electrical power to both upper and lower electrical heating elements 68 and 64, convection fan 78, and convection heating element 80. While known gas ranges utilize 120 volts to operate the burner, broiler, and bake elements, and electric ranges utilize 240 volts to operate the burner, broiler, and bake elements, the gas range described herein utilizes 120 volts to operate both the both the burner and broiler assemblies and the bake elements. Accordingly, the oven described herein facilitates an operator removing an outdated gas range and replacing the gas range with a gas range that includes an electrical baking element that is configured to operate using a standard 120 volt household power supply.

Figure 3:
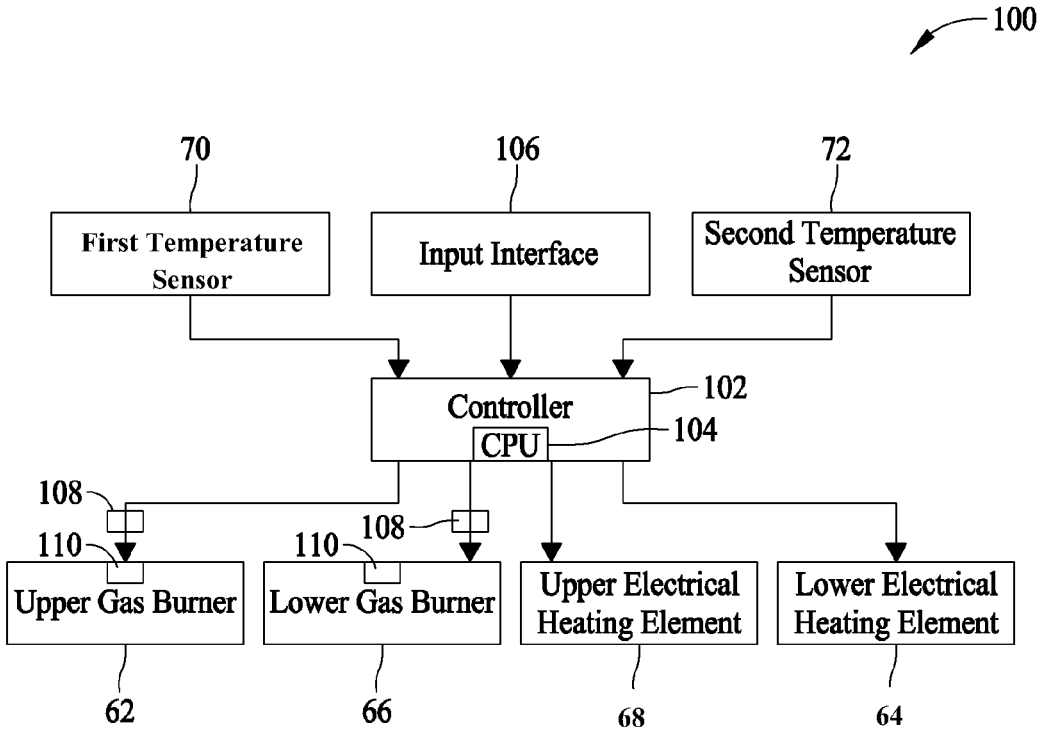
FIG. 3 is a schematic view of a control system that can be used with the dual fuel oven shown in FIG. 1.

FIG. 3 is a schematic illustration of a control system 100 that can be used with range 10 (shown in FIGS. 1 and 2). Control system 100 includes a controller 102 including a computer/microprocessor 104 that is coupled to an input interface 106 and a display (not shown). In the exemplary embodiment, computer/microprocessor 104 includes a RAM memory and/or a permanent memory such a flash memory (FLASH), programmable read only memory (PROM), or an electronically erasable programmable read only memory (EEPROM) as known in the art. Controller 102 is configured to store calibration constants, oven operating parameters, cooking routine recipe information, etc. required to control the oven heating elements and execute user instructions.

In the exemplary embodiment, controller 102 is operatively coupled to a plurality of electrical heating elements such as, but not limited to electrical heating elements 64 and 68 (shown in FIG. 2). Controller 102 is also operatively coupled to a plurality of electrical valves 108 and/or igniters 110 that are configured to channel and ignite gas within a plurality of broiler elements such as, but not limited to, broiler elements 62 and 66 (shown in FIG. 2). Controller 102 is also configured to energize convection element 80 (shown in FIG. 2).

In a first exemplary method of operation, controller 102 is selectively operated to activate or deactivate, i.e. turn on or off, upper gas burner 62, upper heating element 68, and lower gas burner 66. More specifically, control system 100 is selectively operated to facilitate controlling electrical heating element 68 based on a signal received from second temperature sensor 72.

Figure 4:
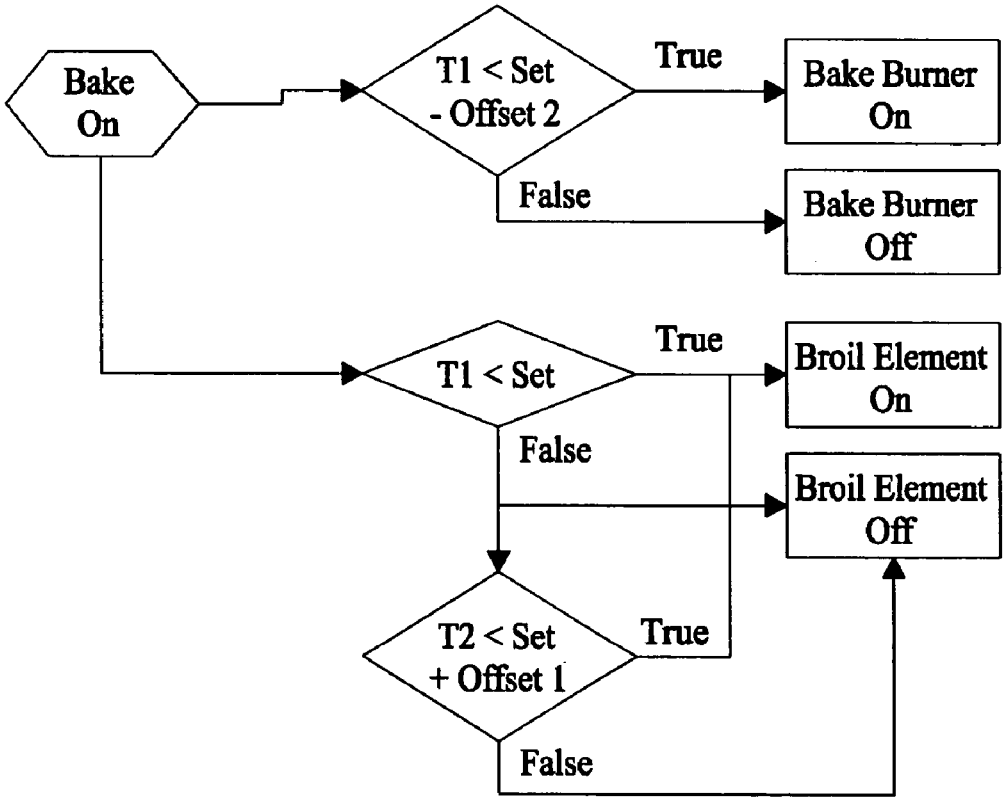
FIG. 4 is a schematic flow chart of an exemplary baking method applicable to the oven shown in FIG. 1.

For example, and referring to FIG. 4, during a baking operation an operator inputs a desired baking temperature into input interface 106. A signal indicative of the desired baking temperature is transmitted to controller 102. Controller 102 also receives a signal from first temperature sensor 70 indicative of an oven cavity temperature approximately midway between upper and lower gas burners 62 and 66.

More specifically, lower gas burner 66 is utilized to preheat oven 50 for the baking operation. After oven 50 is preheated, control system 100 evaluates the input signal received from second temperature sensor 72 and determines whether upper electric heating element 68 should be cycled on or off. In the exemplary embodiment, a temperature of oven upper surface 74 should maintained at a temperature that is approximately equal to a temperature of oven cavity 52 based on the temperature signal received from first temperature sensor 70. Accordingly, electrical heating element 68 is energized and deenergized to increase a temperature of upper surface 74 to facilitate generating a relatively uniform heat distribution within oven cavity 52.

Cycling electric heating element 68 on and off based on a temperature received from second temperature sensor 72 facilitates precisely controlling a temperature of upper surface 74, and therefore increases the top browning performance of oven 50.

During a broiling operation, an operator inputs a desired broiling temperature into input interface 106. A signal indicative of the desired broiling temperature is transmitted to controller 102. Controller 102 also receives a signal from first temperature sensor 70 indicative of an oven cavity temperature approximately midway between upper and lower gas burners 62 and 66.

More specifically, control system 100 evaluates the input signal received from first temperature sensor 70 and determines whether lower gas burner 66 should be cycled on or off. In the exemplary embodiment, a temperature of oven upper surface 74 is monitored using second temperature 72 to determine the lateral side-to-side heat distribution emanating from upper surface 74. Accordingly, electrical heating element 68 is energized and deenergized to increase a temperature of upper surface 74 to facilitate generating a relatively uniform heat distribution within oven cavity 52 based on the input received from second temperature sensor 72.

Cycling electric heating element 68 on and off based on a temperature received from second temperature sensor 72 facilitates precisely controlling a temperature of upper surface 74, and sides 58, and therefore increases the broiling performance of oven 50.

In the exemplary methods described above, second temperature sensor 72 provides a direct feedback indicative of a temperature of oven upper surface 74. Accordingly, upper electrical heating element 68 is selectively energized and deenergized based solely on a temperature signal received from second temperature sensor 72 indicative of a temperature of oven upper surface 74. Selectively energizing/deenergizing upper electrical heating element 68 based solely on a temperature signal received from second temperature sensor 72, facilitates generating a relatively uniform heat distribution within oven cavity 52 and therefore improves the browning, baking, and broiling performance of oven 50.

Figure 5:
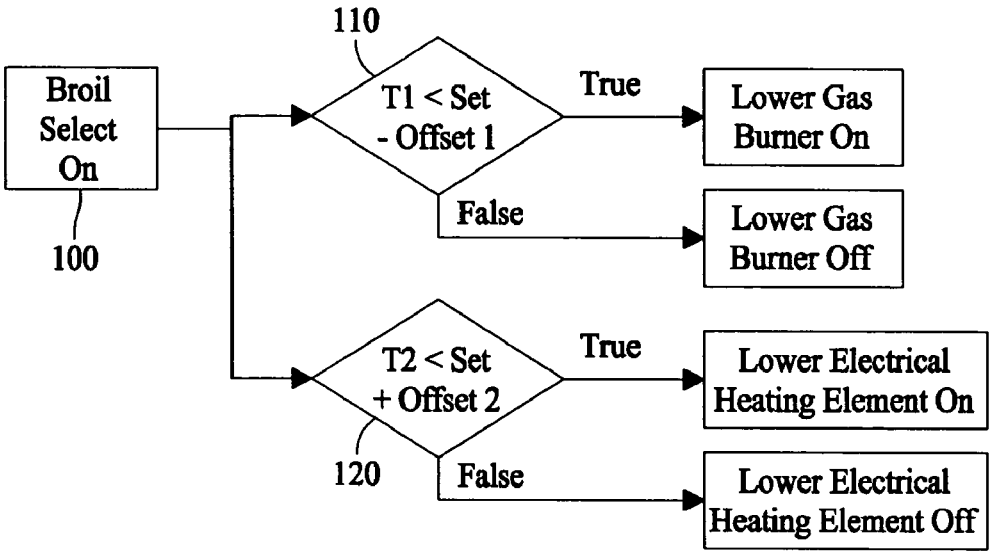
FIG. 5 is a schematic flow chart of an exemplary broiling method applicable to the oven shown in FIG. 1.

FIG. 4 is a flow chart representing a second exemplary method of operating gas range 10. FIG. 5 is a flow chart representing a third exemplary method of operating gas range 10. In the second and third exemplary methods of operation, controller 102 is selectively operated to activate or deactivate, i.e. turn on or off, upper gas burner 62, upper electrical heating element 68, lower gas burner 66, and lower electrical heating element 64. More specifically, control system 100 is selectively operated to facilitate controlling electrical heating elements 64 and 68 based on a signal received from second temperature sensor 72. As used herein to describe FIGS. 4 and 5, T1 is defined as a temperature of oven cavity 50 received from first temperature sensor 70, T2 is defined as a temperature of upper surface 74 received from temperature sensor 72, SET is defined as a desired cooking temperature input by an operator via input interface 106, and OFFSET1 is defined as a predetermined number that is empirically determined that reflects a difference between a temperature received at first temperature sensor 70 and a first predetermined location within oven cavity 52, and OFFSET2 is defined as a predetermined number that is empirically determined that reflects a difference between a temperature received at second temperature sensor 72 and a second predetermined location within oven cavity 52 that is different than the first predetermined location within oven cavity 52.

For example, during a baking operation, an operator inputs a desired baking temperature SET into input interface 106. A signal indicative of the desired baking temperature is transmitted to controller 102. Controller 102 also receives a signal T1 from first temperature sensor 70 indicative of an oven cavity temperature approximately midway between upper and lower gas burners 62 and 66, and a signal T2 from second temperature sensor 72 that is indicative of a temperature of upper surface 74.

In one embodiment, if T1<SET−OFFSET1, than controller 102 activates lower gas burner 66. Alternatively, if T1>SET−OFFSET1 and lower gas burner 66 is currently activated, then controller 102 de-activates lower gas burner 66. If T1<SET, then controller 102 activates upper electrical heating element 68. Alternatively, if T1>SET, and upper electrical heating element 68 is currently activated, then controller 102 de-activates upper electrical heating element 68. Additionally, controller 102 monitors a temperature signal received from second temperature sensor 72 continuously during the baking cycle. If, if T2<SET−OFFSET2, then controller 102 activates electrical heating element 68. Alternatively, if T2>SET−OFFSET2, then controller 102 de-activates electrical heating element 68. Accordingly, and in the exemplary embodiment, controller 102 continuously monitors a temperature of oven cavity 52, and if the temperature of oven cavity 52 is different than the SETPOINT, controller 102 is configured to activate at least one of lower electrical heating element 64 and upper electrical heating element 68 until the desired oven cavity temperature is achieved.

During a broiling operation, an operator inputs a desired broiling temperature SET into input interface 106. A signal indicative of the desired broiling temperature is transmitted to controller 102. Controller 102 also receives a signal T1 from first temperature sensor 70 indicative of an oven cavity temperature approximately midway between upper and lower gas burners 62 and 66, and a signal T2 from second temperature sensor 72 that is indicative of a temperature of upper surface 74. In the exemplary embodiment, at least one of controller 102 and computer/microprocessor 104 includes an algorithm configured to analyzed and perform the functions described herein.

In one embodiment, if T1<SET−OFFSET1, than controller 102 activates upper gas burner 62. Alternatively, if T1>SET−OFFSET1 and upper gas burner 62 is currently activated, then controller 102 de-activates upper gas burner 62. Additionally, if T2<SET−OFFSET2, then controller 102 activates upper electrical heating element 68. Alternatively, if T2>SET−OFFSET2, and upper electrical heating element 68 is currently activated, then controller 102 de-activates upper electrical heating element 68. Accordingly, and in the exemplary embodiment, controller 102 continuously monitors a temperature of oven cavity 52, and if the temperature of oven cavity 52 is different than the SETPOINT, controller 102 is configured to activate at least one of lower electrical heating element 64 and upper electrical heating element 68 until the desired oven cavity temperature is achieved.

The algorithms described herein receives input from a first temperature sensor and a second temperature sensor that is located on or adjacent to the top deflector. The algorithm facilitates utilizing the second temperature sensor input to improve both baking and broiling performance of oven 50. Specifically, the algorithm described herein facilitates improving overall bake/broil evenness and improves top browning utilizing a second independent temperature sensor.

Figure 6:
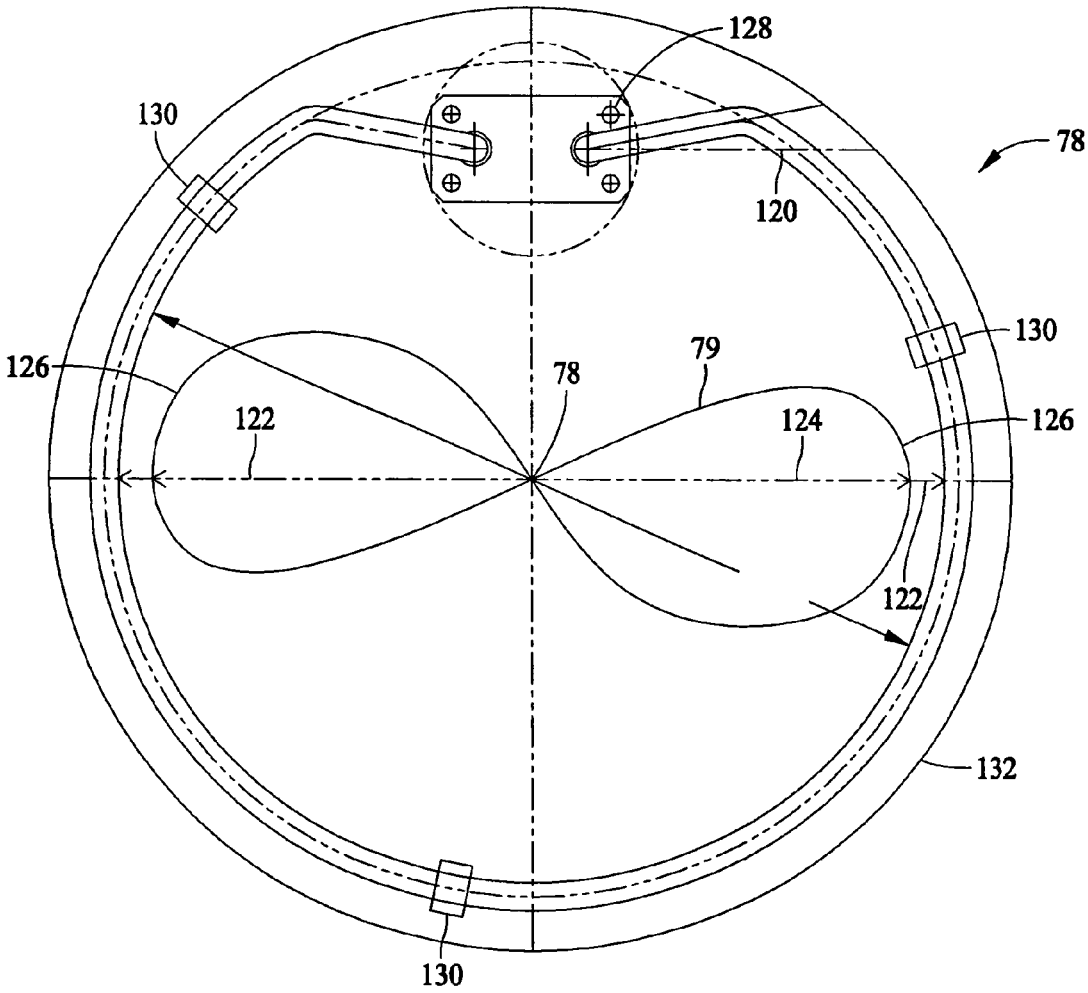
FIG. 6 is an exemplary convection fan that can be used with the oven shown in FIG. 1.

FIG. 6 is a perspective view of electrical convection heating element 120 that may be used with range 10 (shown in FIG. 1). In the exemplary embodiment, convection heating element 120 is a single-pass circular element that includes a circumference 122 that is greater than a circumference 124 of convection fan impeller 79 such that convection heating element 120 is positionable around an outer periphery 126 of convection fan impeller 79. Convection heating element 120 is a relatively low wattage electrical heating element that is configured to electrically couple to a 120 volt power supply using a connector 128. In the exemplary embodiment, convection heating element 120 is configured to consume approximately 1350 watts during operation.

Convection heating element 120 includes a plurality of stand-offs 130, or clips, that are removably coupled to convection heating element 120 and an interior of an oven, such as oven 50 (shown in FIG. 2). Stand-offs 130 are positioned around convection heating element 120 to facilitate to forming a space between convection heating element 120 and back wall 60. A relatively low profile fan cover 132 is then positioned over convection fan impeller 79 and convection heating element 120 to facilitate reducing a possibility that a consumer may contact either convection fan 78 or convection heating element 120. Since convection heating element 120 is positioned around convection fan impeller 79, low profile fan cover 132 may be utilized to facilitate increasing the usable cooking area within oven cavity 50. Additionally, since convection heating element operates using approximately 1350 watts, the convection fan can be operated during any or all of the cooking process, whereas known convection fans operate only during limited periods because the convection heating elements utilize a relatively high power to operate.

Moreover, because oven 50 includes electrical convection heating element 120, fan 78 can substantially and continuously rotate during the convection baking process to facilitate enhancing the baking performance for multi-rack loading foods (not shown) in oven cavity 50. In addition, due to the single-pass configuration of convection heating element 120, fan cover 132 achieves a low profile configuration, such that convection heating element 120 and fan cover 132 occupy a much smaller space in oven cavity 50 compared with traditional two-pass convection heating elements.

Gas range 10, including upper and lower electrical heating elements 64 and 68 facilitate allowing a consumers that currently owns has a gas cooking appliance, to install a gas cooking appliance that includes electrical baking and broiling elements without significant rewiring of the house since gas range 10 utilizes 100 volts. Moreover, the methods and algorithms described herein facilitate improving the overall bake/broil evenness and also improve top browning utilizing a second independent temperature sensor.

Exemplary embodiments of an oven for a gas range. The oven is not limited to the specific embodiments described herein, but rather, components of the oven may be utilized independently and separately from other components described herein. Each portion of the oven can also be used in combination with other oven components.

While the invention has been described in terms of various specific embodiments, those skilled in the art will recognize that the invention can be practiced with modification within the spirit and scope of the claims.

What is claimed is:

1. A gas range comprising:

a gas cooktop comprising a plurality of gas cooktop burners; and an oven coupled to said gas cooktop, said oven comprising:

an oven cavity comprising a top wall, a bottom wall, a rear wall coupled to said top and bottom walls, a first side wall, and a second side wall, said first and second side walls coupled to said top, bottom and rear walls;

a first gas burner positioned proximate to said bottom wall within said oven cavity;

a first electrical heating element positioned proximate said top wall within said oven cavity;

a second electrical heating element positioned proximate said bottom wall within said oven cavity and positioned above said first gas burner;

a first sensor positioned between said top wall and said bottom wall and configured to generate a first signal indicative of a first temperature within said oven cavity approximately midway between said top wall and said bottom wall;

a second sensor coupled to a surface of said top wall and configured to generate a second signal indicative of a second temperature within said oven cavity at the surface of said top wall; and a controller in signal communication with said first sensor and said second sensor, said controller configured to selectively energize and de-energize said first electrical heating element based solely on said second signal to facilitate controlling the second temperature.

2. A gas range in accordance with claim 1 further comprising a 120 volt electrical power interface electrically coupled to said first electrical heating element and said second electrical heating element.

3. A gas range in accordance with claim 1 wherein said first gas burner comprises a bake gas burner positioned proximate said bottom wall and a second gas burner comprising a broil gas burner positioned proximate said top wall of said oven cavity.

4. A gas range in accordance with claim 3 wherein said first electrical heating element is positioned below said second gas burner.

5. A gas range in accordance with claim 1 further comprising: a convection fan comprising an impeller: a convection heating element circumscribing said convection fan impeller; and a convection fan cover circumscribing said convection heating element.

6. A gas range in accordance with claim 1 wherein said first electrical heating element is configured to receive approximately 120 volts alternating current.

7. A gas range in accordance with claim 1 further comprising:

a convection fan impeller;

a convection heating element circumscribing said convection fan impeller, said convection heating element configured to be energized when said first gas burner and said first electrical heating element are energized; and a convection fan cover covering at least a portion of said convection heating element.

8. A gas range in accordance with claim 7 wherein said convection fan is configured to receive approximately 120 volts alternating current.

9. A gas range in accordance with claim 1 wherein said controller is configured to maintain the second temperature at the surface of said top wall substantially equal to the first temperature of said oven cavity at a midpoint within said cavity.

10. A gas range in accordance with claim 1 further comprising a reflector mounted to said top wall, said second sensor configured to detect a third temperature of said reflector.

11. A gas range in accordance with claim 1 wherein, during a baking operation, said first electrical heating element is cycled on and off based on the second signal to facilitate controlling the second temperature at the surface of said top wall.

12. A gas range in accordance with claim 1 wherein, during a broiling operation, said first electrical heating element is cycled on and off based on the second signal to facilitate controlling the second temperature at the surface of said top wall and a third temperature at a surface of at least one of said first side wall and said second side wall.

* * * * *